United States Patent [19]

Kitazawa

[11] 4,062,504

[45] Dec. 13, 1977

[54] APPARATUS FOR CONTINUOUSLY ACCUMULATING A TRAVELLING METAL STRIP OR WIRE-LIKE MATERIAL

[75] Inventor: Yoshio Kitazawa, Kitakyushu, Japan

[73] Assignee: Nippon Steel Corporation, Tokyo, Japan

[21] Appl. No.: 683,219

[22] Filed: May 4, 1976

[30] Foreign Application Priority Data

May 8, 1975 Japan ..... 50-55255

[51] Int. Cl.[2] ..... B65H 75/02; B21C 47/00

[52] U.S. Cl. ..... 242/55; 242/55.16; 242/78

[58] Field of Search ..... 242/55, 54 R, 55.16, 242/67.1 R, 78, 78.1, 78.3; 68/8

[56] References Cited

U.S. PATENT DOCUMENTS

| | | | |
|---|---|---|---|
| 1,759,024 | 5/1930 | Selbach | 242/55.16 |
| 3,139,240 | 6/1964 | Weber | 242/55.16 |
| 3,301,497 | 1/1967 | Okazaki | 242/55.16 X |
| 3,666,194 | 5/1972 | Gosnell | 242/78.3 X |

FOREIGN PATENT DOCUMENTS

| | | | |
|---|---|---|---|
| 1,212,483 | 3/1966 | Germany | 242/55.16 |

*Primary Examiner*—Stanley N. Gilreath
*Assistant Examiner*—John M. Jillions
*Attorney, Agent, or Firm*—Wenderoth, Lind & Ponack

[57] ABSTRACT

An apparatus for continuously accumulating a travelling metal strip or wire-like material in an accumulating space provided within a continuous annealing line, diffusion coating line or the like for performing a winding or re-winding operation for a time corresponding to a treating time. The apparatus has a pair of winding reel devices on opposite sides of the path of the material through the accumulating space, each having a rotary shaft and at least one arm extending radially of the rotary shaft and rotatable around the rotary shaft. Each arm has a folding back roll freely rotatably mounted on the outer end of the corresponding arm, and extending parallel with the axis of the rotary shaft. The locus of the axes of the folding back rolls on one reel device intersects the axis of the rotary shaft on the other reel device. Each of the rotary shafts has a reel receiver thereon for receiving the folding back roll on the other reel with the material therearound. The strip of material is engaged by the folding back roll and moved into the roll receiver to be held thereby, and the corresponding rotary shaft is rotated to wind up the thus folded back strip. At the same time, a portion of the double wound strip on the other reel device is unwound, and the remainder is drawn out from the apparatus. When the desired amount is wound up on the one reel device and the corresponding amount has been completely unwound from the other reel device, the operation is reversed.

4 Claims, 11 Drawing Figures

APPARATUS FOR CONTINUOUSLY ACCUMULATING A TRAVELLING METAL STRIP OR WIRE-LIKE MATERIAL

BACKGROUND OF THE INVENTION

This invention relates to an apparatus for continuously accumulating a travelling steel strip or wire like material to be processed, and more particularly to an apparatus for causing the steel strip or wire-like material to move at a predetermined speed and yet be present in a processing space for a predetermined time.

In a processing line, for example, for a treatment such as annealing or diffusion coating of a steel strip or wire like processed material (hereinafter merely referred to as processed material), the requirements are entirely different from a conventional looping unit having dam function in which the processed material is stored or delivered for coiling, in that the processed material travels constantly at the predetermined line speed at the incoming side and outgoing side of the processing apparatus in which it is to be continuously processed.

For example, in case of the continuous annealing process in a continuous annealing installation, and a continuous galvanizing installation for steel strip, the time the steel strip is treated must be controlled with respect to the processing and the time according to the manufacturing specifications. For example, in case of the continuous annealing, the temperature and time relation is controlled. Accordingly, as the line speed of the steel strip is increased, the length of the continuous processing apparatus, for example, the continuous annealing furnace becomes great and the space and amount of investment required for the installation become enormous.

FIG. 1 shows an example of a conventional continuous annealing furnace, in which in order to shorten the length of the furnace 1, a large number of vertically spaced rolls 2 are arranged along the length of the furnace 1, and the strip S is wound thereon. Even in this type of furnace where the length of the furnace is shortened, for example, it requires a length of 85 meters if the strip S is designed to be processed in the furnace for 5 minutes at a traveling speed of 150 m/min.

SUMMARY OF THE INVENTION

An object of the present invention is to provide a method capable of continuously accumulating a travelling steel sheet or wire-like material in an extremely compact space for processing therein, thereby to reduce greatly the cost of installation.

Another object of the present invention is to provide a simple apparatus for continuously accumulating a travelling steel sheet or wire-like material in a compact space for carrying out the foregoing method effectively.

These objects are achieved by an apparatus according to the invention for continuously accumulating a travelling metal strip or wire-like material in an accumulating space provided within a continuous annealing line, diffusion coating line or the like for performing a winding or re-winding operation for a time corresponding to a treating time, said apparatus comprising: material feeding and withdrawal guide roller means spaced apart along a path of the material; a pair of frame members laterally spaced from each other on opposite sides of the path of the material between said guide roller means and spaced from the path of the material transversely of the lateral spacing between the frame members, a pair of winding reel means each having the same structure and mounted on the respective frame members and projecting toward each other and positioned on transversely opposite sides of said path respectively, said winding reel means each having a rotary shaft rotatably mounted on the corresponding frame member and at least one arm extending radially of said rotary shaft and rotatably mounted on the corresponding frame member for relative rotation around said rotary shaft, said arm having a folding back roll at the outer end thereof, said folding back roll being freely rotatably mounted on said arm and being parallel with the axis of said shaft, the locus of the axes of the folding back roll on one reel means intersecting the axis of the rotary shaft on the other reel means, each said rotary shaft having roll receiving means for receiving a folding back roll on the other reel means with the material therearound; rotary shaft driving means coupled to said rotary shafts for driving said shafts at least in the winding direction; and arm driving means coupled to said arms for driving said arms stepwise for moving a folding back roll into said roll receiving means.

BRIEF DESCRIPTION OF THE DRAWINGS

FIGS. 2 to 7 are shematic diagrams illustrating the method of continuously accumulating a travelling strip according to the present invention, in which FIG. 2 shows the condition before the strip is engaged with a reel in the preparation for the continuous accumulation, FIG. 3 shows the condition where the strip has been doubled and wound on one reel in preparation for processing, FIGS. 4 and 5 show the strip being taken up on the first reel while the strip is unwound from the second reel, and FIGS. 6 and 7 show strip being taken up on the second reel while the strip is unwound from the first reel;

DESCRIPTION OF THE PREFERRED EMBODIMENTS

Figure 1:
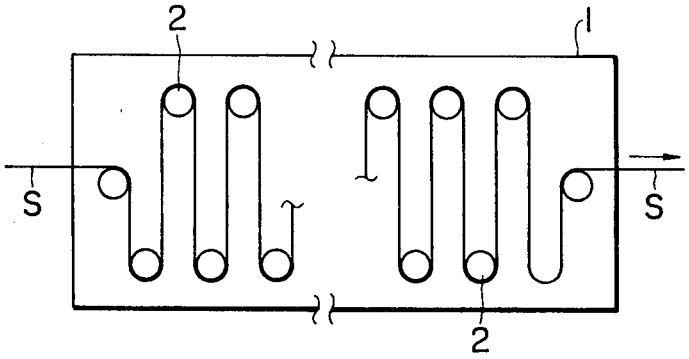
FIG. 1 PRIOR ART
FIG. 1 is a schematic drawing illustrating a conventional continuous processing method for a strip.

FIGS. 2 to 7 illustrate the way in which the steel strip or wire-like material is accumulated according to the present invention. In these drawings, $S_1$, $S_2$, $S_3$, $S_4$ denote portions of strips.

Reference numeral 5 denotes the outer shell of a processing apparatus for the strip, and enclosing a processing space for processing the strip. Numerals 6 and 7 denote deflector rolls which are provided at the strip entrance and exit locations inside the outer shell 5. Reels 11 and 11' are provided above and below the line between the entrance and exit and project toward each from frame members 12 and 12' on laterally opposite sides of the path of the strip to hold the strip in the doubled back condition on the reels and perform the take-up or rewinding operation. The reels 11 and 11' are rotatably driven by motors respectively.

Figure 8:
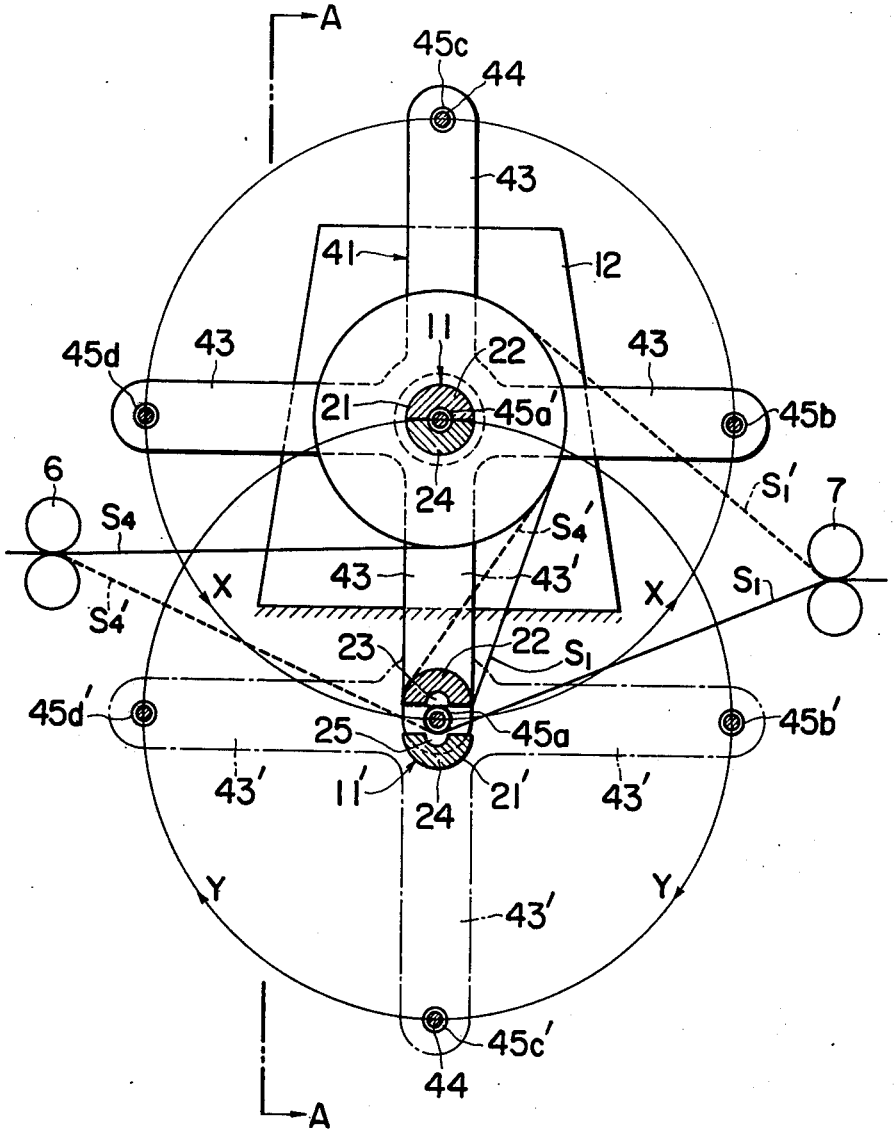
FIG. 8 is a side elevation view showing an embodiment of the apparatus according to the present invention for doubling the strip and holding it on a reel drum.
Figure 9:
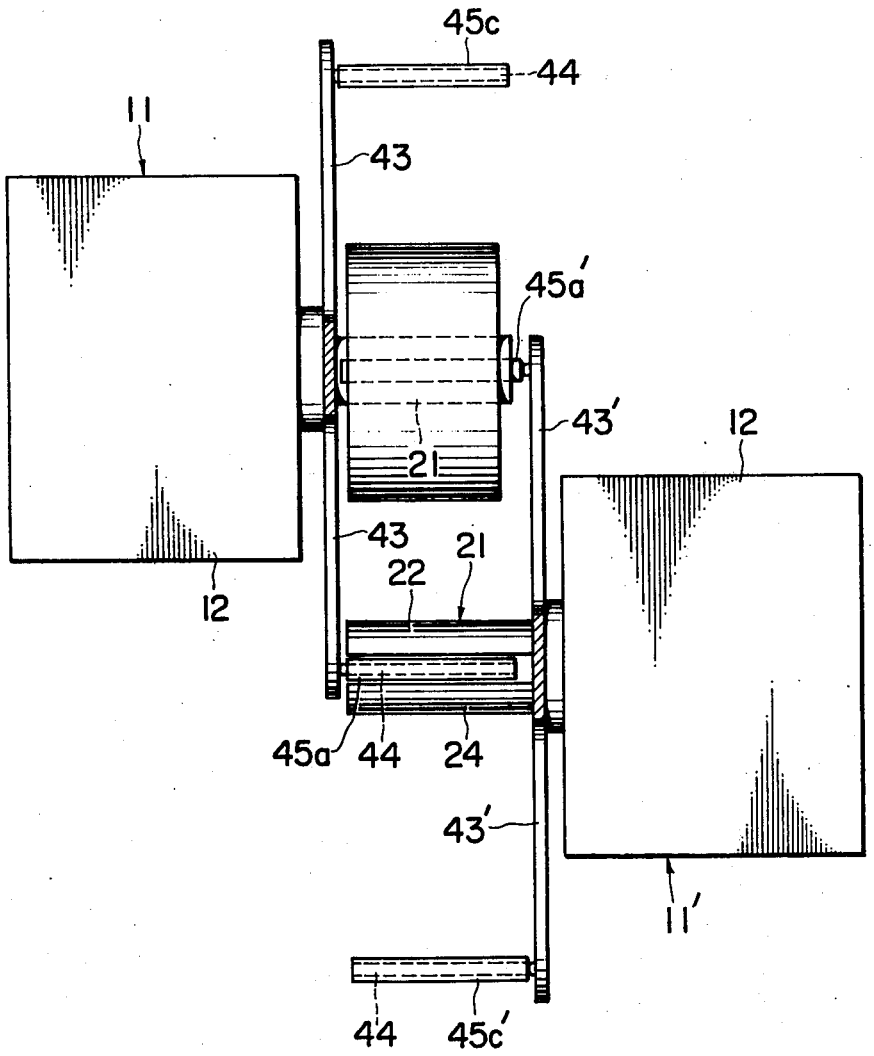
FIG. 9 is an end view of the apparatus shown in FIG. 8 taken along a line A—A of FIG. 8.

The reels 11 and 11' are provided with a folding back means 41 for doubling back the strip and attaching it to the hub of a reel, for example, as shown in FIGS. 8 and 9. In FIGS. 8 and 9, a cross shaped member 42 having arms 43 has the center coinciding with the axis of the hub 21 of reel 11 and is rotatable independently of the reel 11. At the tip of each arm 43 is a pin 44 extending parallel with the axis of the hub of the reel 11, and folding back rolls 45*a*, 45*b*, 45*c*, and 45*d* are rotatably mounted on the respective pins 44. The member having arms 43 is rotated by a motor (not shown) in frame member 12 in 90° increments. The reel 11' has a similar structure, having arms 43', pins 44' and rolls 45*a'*, 45*b'*, 45*c'* and 45*d'*.

The length of the arms 43 is such and the hubs 21 and 21' are spaced such that, when an arm 43 provided on the reel 11 is rotated by ¼ turn in the direction of the arrow, namely the counterclockwise direction in the drawing, the center of rotation of the folding back roll on the end thereof and the center of rotation of the reel 11' coincide. The hub 21' of the reel 11' has roll receiving means, here shown as hub segments 22 and 24, and when the folding back roll is displaced so as to coincide with the hub 21' of the reel 11', the segments are separated in the radial direction as shown in FIG. 8, for example, by a fluid hydraulic mechanism. Also, in each of the hub segments 22 and 24, opposing half round grooves 23 and 25 are formed which together form a cylindrical bore 26 that accommodates a folding back roll 45.

When the axis of the folding back roll and the axis of the hub 21' of the reel 11' coincide, the hub segments of the reel 11' are closed and the hub holds the folding back roll. Likewise when the arms 43' on reel 11' are rotated in the direction of arrow in FIG. 8, namely, in the clockwise direction in the drawing, around the axis of the hub 21' of reel 11', the center of rotation of the folding back roll will coincide with the axis of the hub 21 of the other reel 11. FIG. 8 shows the condition where the folding back roll 45*a'* is accommodated in the hub of the reel 11 and the hub of the reel 11 is closed.

Figure 10:
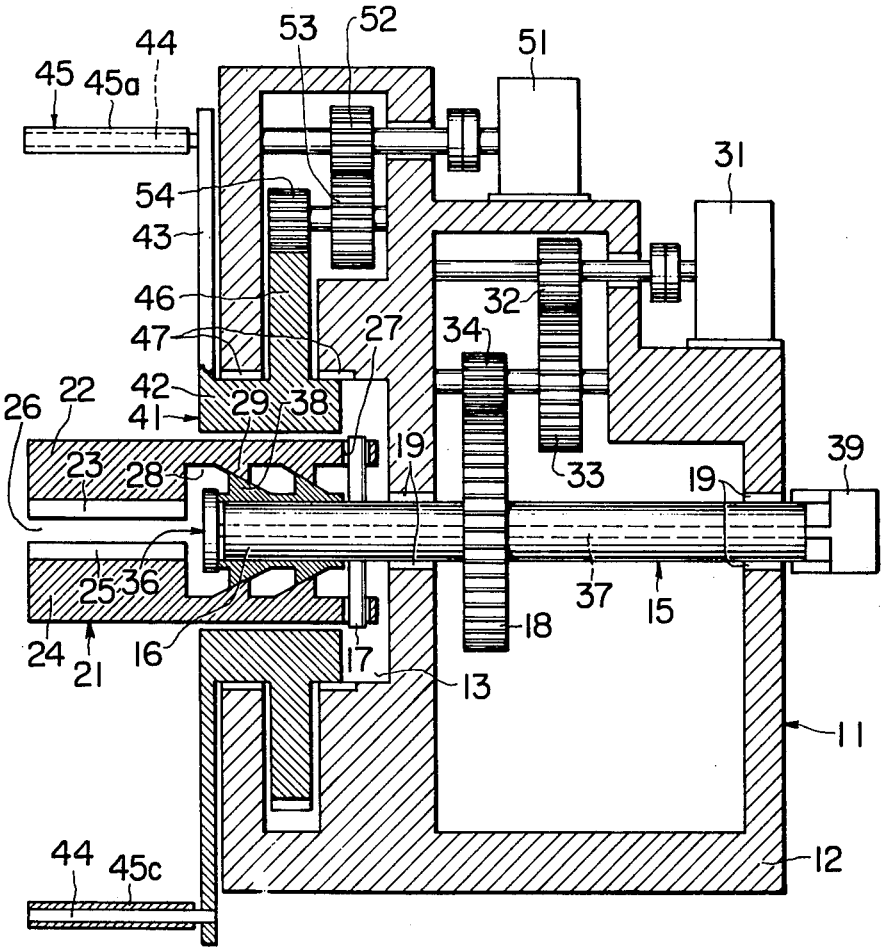
FIG. 10 is a detailed cross section of the apparatus shown in FIG. 8.

FIG. 10 is the cross section showing in detail the drive means for the reel 11.

In FIG. 10, a drive shaft 15 is rotatably supported on the frame 12 by means of bearings 19, and the front part 16 of the drive shaft 15 projects into the concave recess 13 formed on one side of the frame 12. The front part 16 of the drive shaft 15 is coupled to the hub 21 consisting of the pair of hub segments 22 and 24 as described above. Radial holes 27 are formed toward the rear ends of the hub segments 22 and 24, and a drive bar 17 fixed to the drive shaft 15 and extending in the radial direction extends through the holes 27. The hub segments are thus free to slide radially on drive bar 17. On the intermediate portion of the drive shaft 15 is mounted a gear 18, and the torque of a motor 31 fixed to the frame 12 is transmitted to the gear 18 by means of gears 32, 33 and 34. Accordingly, the drive shaft 15 is rotated by the motor 31, and the rotation is transmitted to the hub 21 by means of the drive bar 17.

On the hub carrying end of the drive shaft 15 is slidably mounted an expanding member 36 for opening and closing the hub segments 22 and 24. The expanding member 36 is provided with wedge portions 38 which are inclined toward the driven end (in the drawing, in the right-hand direction) and the end of a rod 37 is connected to member 36, and the rod 37 itself is slidably positioned in an axial hole extending along the axis of the drive shaft 15. The rear end of the rod 37 is connected to a hydraulic cylinder 39, and the expanding member 36 is moved back and forth by the hydraulic cylinder 39. The portions of the segments of the hub 21 around the end of drive shaft 15 have opposed recesses defining cavity portion 28, and wedge portions 29 project from the hub segments into the cavity portion 28 and are inclined towards the front of the hub 21. The wedge portions 29 on the hub segments and the wedge portions 38 on the expanding member 36 are in sliding contact. Moreover, one of the wedge portions 29 and 38 is in a dovetail groove extending in the longitudinal direction of the hub segment, and the other wedge portion fits into the groove. Accordingly, when the expanding member 36 moves back and forth along the drive shaft, the hub segments 22 and 24 are radially contracted and expanded. The hub 21 can be formed not only in two parts as described above, but also may be formed of more than three segments.

A hollow cylindrical body forming part of the cross-shaped member 42 of the folding back unit 41 is located in the recess 13 of the frame 12, and is rotatably supported on the frame 12 by means of a bearing 47. The cylindrical body has the arms 43 mounted thereon at 90° intervals, and the pins 44 are mounted on the tips of the respective arms 43 as described above, and the folding back rolls 45 are rotatably mounted on the pins 44. On the rear part of the cylindrical body is a gear 46 and a motor 51 mounted on the frame 12 is coupled to the gear 46 by means of gears 52, 53 and 54. To fold the strip S back into the bore 26 of the hub 21, and arm 43 is rotated 90° by the motor 51 as described above.

Figure 11:
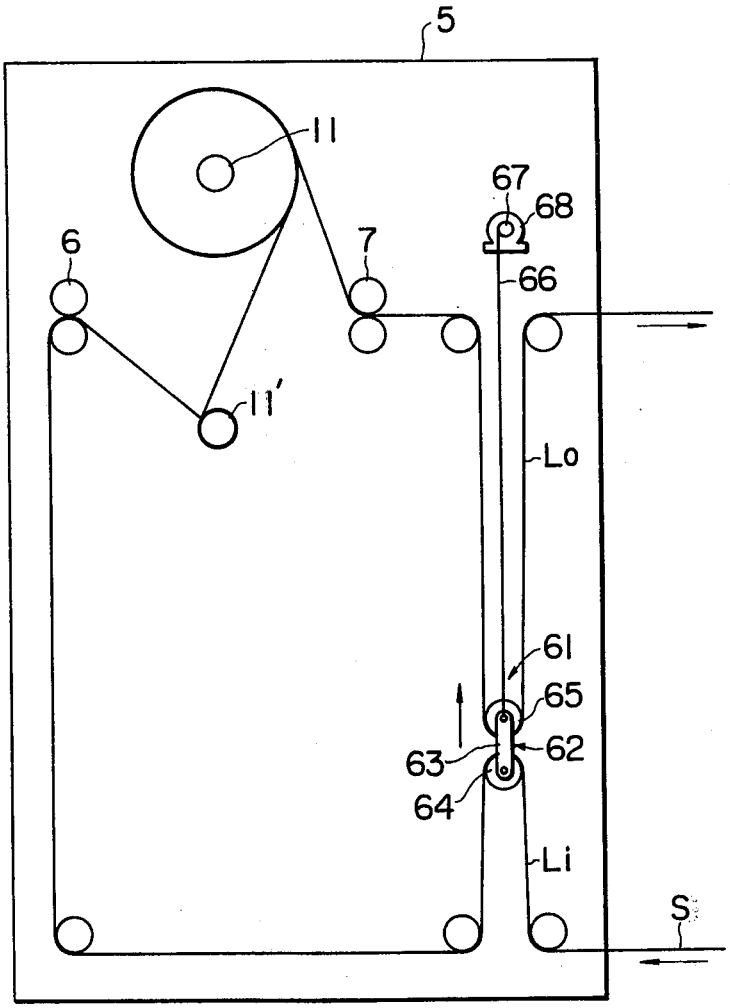
FIG. 11 is a schematic drawing showing an embodiment in which a looping unit is added to the accumulating apparatus for the strip according to the present invention.

FIG. 11 shows a looping unit in which when the strip is retained by the reels 11 and 11' in a folded back condition, even though the forward movement of the strip is stopped for a slight time the speed of the strip coming into the strip processing apparatus or moving out from the processing apparatus is not changed.

In the drawing, a carriage 62 of a looping unit 61 has rolls 64 and 65 rotatably mounted on the upper and lower ends of a frame 63, and the strip S fed into the processing space 5 is passed over the lower roll 64, and the strip fed out of the processing space 5 is passed under the upper roll 65. The upper end of the frame 63 is connected to the tip of a rope 66 wound on a drum 67. The drum 67 is rotatably driven by a motor 68, and the carriage 62 is shifted in the direction of a line connecting the axial centers of the rolls 64 and 65, namely, is shifted vertically. Thus the sizes of the incoming loop L*i* and outgoing loop L*o* are correspondingly increased and decreased by displacing the carriage 62 in the vertical direction.

Next, the operation of the accumulating apparatus according to the present invention will be described.

Figure 2:
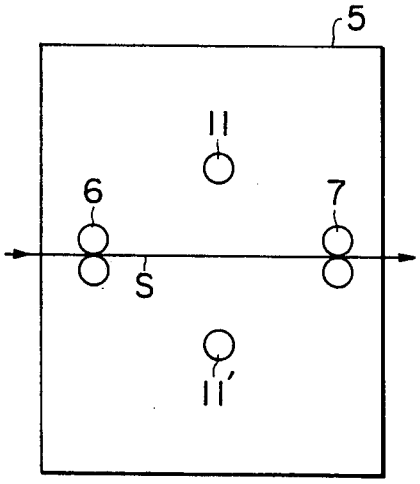
Figure 3:
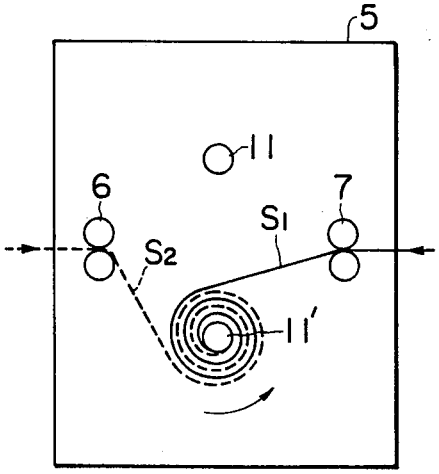

To prepare the apparatus for operation, first, as shown in FIG. 2, the strip S is passed through the deflector rolls 6 and 7 without being wound on the reels 11 and 11', and a length of the strip is fed out through the outer shell 5 equal to the length which is to be wound on one of the reels 11 and 11'. Then, as shown in FIG. 3, the strip S is folded over in the outer shell 5, and the folded back portion is gripped by the hub on the reel 11' and the reel 11 is rotated in the counterclockwise direction. At this time, the strip portion S, on the outgoing side is drawn back into the outer shell 5 and wound up on the reel 11' together with the strip portion $S_2$ being drawn in from the incoming side in a double thickness.

Figure 4:
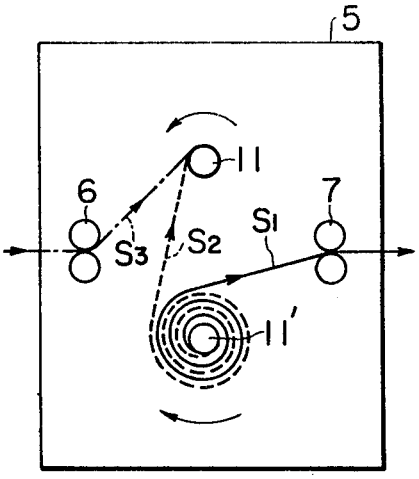
Figure 5:
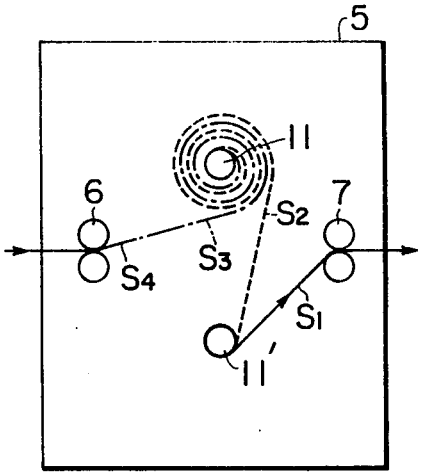

As shown in FIG. 4, the incoming strip portion $S_2$ is then folded back and the folded back portion is gripped by the hub segments on reel 11. Next, the reel 11' is rotated in the clockwise direction and the reel 11 is rotated in the counterclockwise direction as viewed in FIG. 4. The strip portion $S_1$ shown by the solid line is unwound and fed out of the outer shell 5 through the deflector rolls 7. The strip portion $S_2$ shown by the dotted line is unwound from reel 11' and doubled with strip portion $S_3$ and taken up on the reel 11. When the strip portion $S_1$ from the reel 11' has been completely unwound and fed out of the shell 5, the strip portion $S_3$ coming into the shell and the strip portion $S_2$ unwound from reel 11' have been taken up on the reel 11 in doubled up condition and are in the condition shown in FIG. 5. At this time, the hub segments of the reel 11' are moved apart as shown in FIG. 8 and the arms 43 are rotated counterclockwise by 90°. Since the strip portion $S_1$ is accommodated around folding back roll 45*a* on the tip of one arm 43 on the reel 11, and when the arms 43 are rotated, the folding back roll 45*a* is displaced from between the segments of the hub of reel 11' and reaches the position of the folding back roll 45*b* shown in FIG. 8. When the folding back roll 45*a* reaches the position of the folding back roll 45*b* as shown in FIG. 8, the strip portion $S_1$ which has heretofore been around roll 45*a* is separated from the roll 45*a*, and the strip portion $S_1$ reaches the position $S_1'$ shown by the dotted line in FIG. 8.

Figure 6:
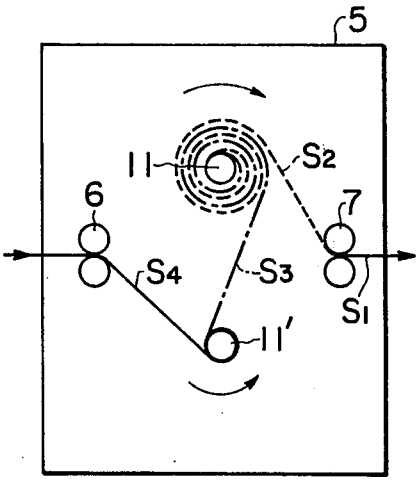
Figure 7:
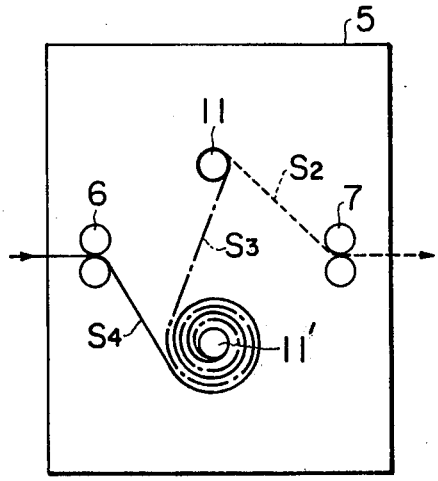

On the other hand, the arm 43 carrying the folding back roll 45*d* shown in FIG. 8 moves 90° and roll 45*d* engages the strip portion $S_4$ and carries it between the hub segments of the reel 11'. That is to say, it moves to the position previously occupied by the folding back roll 45*a* shown in FIG. 8 with the strip portion $S_4$ therearound and the strip portion $S_4$ is in the position $S_4'$. Then the hub segments of the reel 11' are closed around the folding back roll 45*d* and the strip portions are then in the condition as shown in FIG. 6. Then the reel 11 is rotated in the clockwise direction in FIG. 6, and simultaneously the reel 11' is rotated in the counterclockwise direction. The strip portion $S_2$ in unwound and fed out of the shell 5 through the deflector rolls 7, and the strip portion $S_3$ is unwound from the reel 11, and is doubled with and wound on the reel 11' together with the strip portion $S_4$ coming from the outside the shell 5. Eventually the apparatus reaches the condition shown in FIG. 7. The foregoing process is repeated continously.

In the foregoing operations, the speed of the strip fed into the processing shell 5 and the speed of the strip fed out from the processing shell 5 are equal, and the rotating speeds of the reels 11 and 11' are adjusted so that the take-up speed and the rewinding speed of the reels 11 and 11' become equal to said speeds. With the reels 11 and 11' or the reel and deflector rolls, there is no chance that slackening of strip or the excessive tension the strip occur. Also, the time the strip remains in the processing shell 5 for the processing such as annealing, namely, the processing time, is predetermined by the amount of the strip taken up on the reel on the basis of the transfer speed of the strip. For example, if the transfer speed of the strip is constant, in order to increase the processing time, the amount of strip taken up must be increased.

During the time when the strip is folded back and gripped by the reel hub and the take-up is changed between the reels 11 and 11', the transfer of the strip must be stopped even through it is only for a short time. At this time, as shown in FIG. 11, the carriage 62 is lifted at a speed depending on the transfer speed of the strip. During this lifting, the strip is delivered from the loop L*o* of the looping unit 61, and the strip is stored in the loop L*i* and the strip enters from outside the system at the predetermined speed, and is also fed out of the system.

In the foregoing operation, the adjustment of the rotating speed of the reel and adjustment of the strip tension are performed by automatically controlling the drive motor so that it is in accord with the strip speed outside of the system. Also, the stopping of the reels is performed automatically by detecting the number of turns of the strip on the reel, and successive expansion and contraction of the drum, folding back of the strip, changeover of the reel take-up and rewinding operation and the restarting are performed automatically.

Although the foregoing embodiment shows the accumulated material in the form of a strip, this invention can also be applied to a wire like material such as steel wire.

The strip or wire like material accumulating apparatus according to the present invention has been constructed and arranged to operate as described in the foregoing, and in comparison with a conventional system, in which, for example, the length of an apparatus for processing steel strip for 5 minutes at a traveling speed of 150 m/min. will require a length of 85 meters, which is an enormous installation, with the accumulating apparatus according to the present invention, the length will be only 6 – 10 meters. When the reels 11 and 11' are sufficiently large to take up and rewind coil of 10 tons, and assuming that the thickness and the width of the strip are 0.5 mm × 1000 mm, the length of the strip to be taken up on the reel becomes about 2,550 m, and the processing time will be 17 minutes. For reference, assuming that the hub diameter of the reels 11 and 11' is 712 mm, the outside diameter of the coil of strip is 1470 mm, the dimension of the processing apparatus including the reels 11 and 11' will be extremely compact and only a fraction of the size of the apparatus requiring the conventional length. Also, in the conventional processing apparatus, the length of the apparatus as described above will become enormous if the time required for the processing is several hours, and such an apparatus is not practical. For example, if the travelling speed of the strip is 150 m/min., a processing time of up to 5 minutes is the limit from the standpoint of the size of a conventional installation, whereas in the case of the present invention, the processing time can be up to 20 minutes and yet the processing can be satisfactorily performed.

As described in the foregoing, by the use of the accumulating apparatus for strip or wire like material according to the present invention, it becomes possible to greatly reduce the size of the conventional continuous processing apparatus for strip or wire like material and also the installation and the space required for the installation can be made extremely small, which are very beneficial effects of the present invention.

What is claimed is:

1. An apparatus for continuously accumulating a travelling metal strip or wire-like material in an accumulating space provided within a continuous annealing line, diffusion coating line or the like for performing a winding or rewinding operation for a time corresponding to a treating time, said apparatus comprising:

material feeding and withdrawal guide roller means spaced apart along a path of the material;

a pair of frame members laterally spaced from each other on opposite sides of the path of the material between said guide roller means and spaced from the path of the material transversely of the lateral spacing between the frame members;

a pair of winding reel means each having the same structure and mounted on the respective frame members and projecting toward each other and positioned on transversely opposite sides of said path respectively, said winding reel means each having a rotary shaft rotatably mounted on the corresponding frame member and at least one arm extending radially of said rotary shaft and rotatably mounted on the corresponding frame member for relative rotation around said rotary shaft, said arm having a folding back roll at the outer end thereof, said folding back roll being freely rotatably mounted on said arm and being parallel with the axis of said shaft, the locus of the axes of the folding back roll on one reel means intersecting the axis of the rotary shaft on the other reel means, each said rotary shaft having roll receiving means for receiving a folding back roll on the other reel means with the material therearound;

rotary shaft driving means coupled to said rotary shafts for driving said shafts at least in the winding direction; and arm driving means coupled to said arms for driving said arms stepwise for moving a folding back roll into said roll receiving means.

2. An apparatus as claimed in claim 1 in which said roll receiving means comprises a clutch means on each rotary shaft and having a pair of opposed hub segments movable toward and away from each other for clutching and releasing a folding back roll on the other reel means with the material therearound, said hub segments when they are moved away from each other being spaced sufficiently to accomodate a folding back roll therebetween, said clutch means further having actuating means coupled to said hub segments for moving said hub segments toward and away from each other, said arm driving means driving said arms stepwise for moving a folding back roll between the hub segments of said clutch means.

3. An apparatus as claimed in claim 1 in which said material feeding and withdrawal guide roller means are spaced apart along a horizontal path, and said frame members are on laterally opposite sides of said path with one frame member being above the path and the other frame member being below the path.

4. An apparatus as claimed in claim 1 in which there are a plurality of arms extending radially of each rotary shaft and each has a folding back roll at the outer end thereof.

* * * * *